US008375763B2

(12) United States Patent
Bauer et al.

(10) Patent No.: US 8,375,763 B2
(45) Date of Patent: Feb. 19, 2013

(54) FOLDING DEVICE AND METHOD FOR THE FOLDING OF WORKPIECES

(75) Inventors: Herbert Bauer, Ruesselsheim (DE); Reimund Ewald, Riedstadt (DE); Peter Nold, Buettelborn (DE); Gregor Ruf, Nackenheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 702 days.

(21) Appl. No.: 12/520,066

(22) PCT Filed: Dec. 17, 2007

(86) PCT No.: PCT/EP2007/064072

§ 371 (c)(1),
(2), (4) Date: Dec. 21, 2009

(87) PCT Pub. No.: WO2008/074775

PCT Pub. Date: Jun. 26, 2008

(65) Prior Publication Data

US 2010/0101297 A1 Apr. 29, 2010

(30) Foreign Application Priority Data

Dec. 19, 2006 (DE) ..... 10 2006 059 962

(51) Int. Cl.
*B21D 5/01* (2006.01)
*B21D 5/16* (2006.01)

(52) U.S. Cl. ..... 72/386; 72/452.9

(58) Field of Classification Search ..... 72/312–315, 72/322, 323, 381, 384, 386, 452.1, 452.8, 72/452.9

See application file for complete search history.

(56) References Cited

U.S. PATENT DOCUMENTS 6,196,041 B1 3/2001 Codatto
6,363,766 B1 4/2002 Kunze (Continued)

FOREIGN PATENT DOCUMENTS

CN 1247342 A 3/2000
DE 69805631 T2 11/2002

(Continued)

OTHER PUBLICATIONS

International Searching Authority, International Search Report for European Application No. PCT? WP207/064072, dated Jun. 6, 2008.

(Continued)

*Primary Examiner* — Debra Sullivan
(74) *Attorney, Agent, or Firm* — Ingrassia Fisher & Lorenz, P.C.

(57) ABSTRACT

A folding device is provided for the processing of workpieces and includes, but is not limited to a holding device for the holding of a workpiece in a processing position in a holding plane and a folding slide for the folding over of an edge of the workpiece into a folding position. The folding slide at least includes, but is not limited to a first folding surface and a second folding surface. The first folding surface with the second folding surface forms an angle $\alpha$, the first folding surface with the holding plane forms an angle $\beta_1$ and the second folding surface with the holding plane forms an angle $\beta_2$ and the first folding surface and the second folding surface are intended for pressing onto the workpiece during the folding over of an edge.

9 Claims, 11 Drawing Sheets

U.S. PATENT DOCUMENTS

| | | | |
|---|---|---|---|
| 2008/0083258 | A1 | 4/2008 | Dahler et al. |
| 2010/0101297 | A1 | 4/2010 | Bauer et al. |

FOREIGN PATENT DOCUMENTS

| | | | | |
|---|---|---|---|---|
| DE | 60000843 | T2 | | 4/2003 |
| DE | 102004031290 | A1 | | 2/2006 |
| EP | 0490828 | A1 | | 6/1992 |
| EP | 1103319 | A1 | | 5/2001 |
| GB | 2362735 | A | | 11/2001 |
| JP | 58212819 | A | | 12/1983 |
| JP | 03081022 | A | * | 4/1991 |
| JP | 9271856 | A | | 10/1997 |
| JP | 2005305493 | A | | 11/2005 |
| WO | 2008074775 | A1 | | 6/2008 |

OTHER PUBLICATIONS

China Patent Office, Chinese Office Action for Application No. 200780051530.7, dated Sep. 3, 2010.

China Patent Office, Chinese Office Action for Application No. 200780051530.7, dated Mar. 9, 2011.

* cited by examiner

FOLDING DEVICE AND METHOD FOR THE FOLDING OF WORKPIECES

CROSS-REFERENCE TO RELATED APPLICATIONS

This application is a U.S. National-Stage entry under 35 U.S.C. §371 based on International Application No. PCT/EP2007/064072, filed Dec. 17, 2007, which was published under PCT Article 21(2) and this application also claims priority to German Application No. 102006059962.4, filed Dec. 19, 2006, which are all hereby incorporated in their entirety by reference.

TECHNICAL FIELD

The invention relates to a folding device for the processing of workpieces, more preferably of vehicle parts. It further relates to a method for the folding of workpieces.

BACKGROUND

When manufacturing vehicle parts such as motor vehicle doors for example the individual parts such as the outer skin are initially manufactured in press tools from the raw blank and in subsequent processes assembled with additional parts such as the framework and reinforcements for example. The manufacture of the individual parts includes various individual processes such as the drawing, the cutting to size, the vertical folding and the folding of flanges into a pre-flanging position before the individual parts prepared in this manner are assembled and finish-flanged and thus joined to one another.

Generally, different tools are also provided for the numerous different process steps for which in the production a relatively large space is required for the respective operations. For example the cutting to size and folding of a sheet for example for the outer skin of a vehicle is conventionally carried out in a plurality of press tools and the sheet so processed subsequently pre-flanged and finally finish-flanged in a flanging device on a flanging bed by means of flanging rollers or flanging jaws in a plurality of steps.

In addition, the individual part to be manufactured has to be removed from a press tool for every process step and placed into a following one, which is very time consuming, more so since the workpiece in each case has to be exactly positioned and fixed for an optimal processing result. In addition, this procedure involves considerable tool investment.

At least one object of the invention therefore is to state a folding device which allows both space and time saving processing of workpieces during the preparation of the assembly and the flanging. A further object is to state a particularly simple and quick method for the folding of workpieces. In addition, other objects, desirable features, and characteristics will become apparent from the subsequent summary and detailed description, and the appended claims, taken in conjunction with the accompanying drawings and this background.

SUMMARY

A folding device according to an embodiment of the invention for the processing of workpieces comprises a holding device for the holding of a workpiece in a processing position in a holding plane. It also comprises a folding slide for the folding over of an edge of the workpiece into a folding position wherein the folding slide comprises at least one first folding surface and a second folding surface. The first folding surface forms an angle $\alpha$ with a second folding surface and an angle $\beta_1$ with the holding plane. The second folding surface forms an angle $\beta_2$ with the holding plane. The first folding surface and the second folding surface are intended for the pressing against the workpiece during the folding over of an edge.

"Folding" here and in the following means the bending over of an edge (i.e., a marginal region), of a workpiece by a defined angle. The pre-flanging is thus a special form of folding which prepares an edge directly for a finish-flanging process.

"Folding position" here and in the following means the position of an edge as it has to be achieved after the folding for subsequent process steps. More preferably, when using the folding device for pre-flanging it means the position of the edge that has to be reached in order to be able to subsequently perform the finish-flanging.

The folding device according to an embodiment of the invention has the advantage that it makes possible the folding over of edges of a workpiece in a single step even with workpieces wherein various edges have to be folded over by angles of different sizes (i.e., different folding positions have to be reached. Thus the number of process steps required for the processing of the workpiece is reduced).

This is the case for example with the outer skin of motor vehicle doors whose edges in the region of the sill have to be folded over by approximately 105 degrees, in all remaining regions however only by approximately 90 degrees. Conventionally, all edges with such a workpiece were initially folded over in a workpiece by approximately 90 degrees and subsequently the regions requiring greater bending, subsequently re-processed in another tool.

The folding device according to the invention however makes possible the folding of all edges of a workpiece in a single step. To this end, the folding slide of the folding device is moved into the appropriate working position in each case so that its first or its second or, if applicable, also additional folding surfaces are brought into contact with the workpiece. Here, each of the folding surfaces is designed so that it folds over the edge of the workpiece by a predetermined angle.

When using the folding device for pre-flanging the angle is so selected that finish-flanging can subsequently take place without additional pre-flanging steps. During finish-flanging the flange of a workpiece is completely folded over and closed. Since in a single flanging pass a flange cannot be folded over by an angle of any size, folding or pre-flanging processes have to be provided prior to finish-flanging as the result of which the flange of a workpiece already comprises a pre-flanging position so that it can be finish-flanged in one pass.

In a preferred exemplary embodiment the holding plane is substantially arranged horizontally and $\beta_1$ is substantially equal to 90° and $\beta_2>90°$ applies. With this exemplary embodiment first regions of the workpiece, which are folded over through the first folding surface of the folding slide, are folded over by an angle of approximately 90° so that they are vertically orientated. Second regions of the workpiece are folded through a greater extent by the second folding surface, preferentially by an angle $\beta_2$ with approximately $100° \leqq \beta_2 \leqq 110°$.

Here, the folding of the various regions however does not take place in a plurality of passes as with conventional methods, but the edges of the workpieces are all angled-off in a single step from their typically flat position (i.e., not folded at all), to their respective folding or pre-flanging position.

In an embodiment the folding device comprises a hold-down which is designed to fix the workpiece on a support during folding.

Preferentially the folding device comprises at least one filling slide having two surfaces which during folding can be brought into contact with the workpiece, wherein one of the surfaces lies in the holding plane and another surface is designed as a pressing-on surface inclined relative to the holding plane by an angle γ.

Providing such a filling slide has the advantage that following the folding it is removed from its working position on the workpiece simply through sliding back and thus vertically releases the workpiece so that it can be easily removed from the folding device. The angle γ is preferentially selected so that it complements the angle, by which the edges in the second folding regions are folded over, to approximately 180 degrees. This has the advantage that the workpiece during folding can be pressed against the pressing-on surface by the folding slide so that the aspired folding angle is exactly defined and securely reached.

A method 100 (see FIG. 11) for the folding of workpieces according to an embodiment of the invention comprises the following steps: initially, a folding device is loaded (step 102 in FIG. 11) with a workpiece by placing the workpiece on a support in a holding plane, wherein a front region of the workpiece to be folded protrudes over the support. The workpiece is fixed (step 104 in FIG. 11) on the support through a hold-down.

After this, a folding slide of a folding tool is moved (step 106 in FIG. 11) into a first working position and the edge of a first folding region of the workpiece folded (step 108 in FIG. 11) with the folding slide and folded over as far as a folding position. In the process, a first folding surface of the folding slide is brought (step 110 in FIG. 11) into contact with a top side of the front region of the workpiece.

Following this, the folding slide is moved (step 112 in FIG. 11) into a second working position and the edge of a second folding region of the workpiece folded with the folding slide, wherein a second folding surface of the folding slide is brought (step 114 in FIG. 11) into contact with a top side of the front region of the workpiece and folds over the edge as far as into a folding position.

After this the folding slide is moved (step 116 in FIG. 11) into a rest position and the workpiece released (step 118 in FIG. 11) through removing the hold-down so that the folded workpiece can be removed from the folding device.

In the event that the workpiece comprises more than two folding regions these are likewise folded over into their respective folding position with further folding surfaces of the folding slide before the folding slide is moved back into its rest position.

In an embodiment of the method the folding slide is vertically lowered from its rest position into its first working position. Preferably it is also vertically lowered from its first working position into its second working position. In the process, the first and the second folding surface are arranged on top of each other relative to the holding plane so that a complicated method of the folding slide is not necessary but the latter merely needs to be lowered or raised in order to move from a working position into the other or into the rest position.

In an embodiment the support with the workpiece is arranged on a turntable (step 103 in FIG. 11) and the support with the workpiece rotated (step 109 in FIG. 11) against the stationary folding tool during folding. In an alternative embodiment the folding tool can conversely also move around the support with the workpiece which is stationary during the folding with a rotary filling slide.

A method according to an embodiment of the invention for the manufacture of a vehicle part comprises the following steps: initially folding and pre-flanging takes place on an outer skin with the help of the method described. Following this, a flanging bed is loaded with the pre-flanged outer skin and with a workpiece intended for joining with the outer skin. The joining of the outer skin with the workpiece provided for the joining with the outer skin then takes place through finish-flanging. The workpiece provided for the joining with the outer skin can be a framework and/or reinforcement parts.

The folding device according to an embodiment of the invention can more preferably be advantageously employed for the folding and pre-flanging of sheets for vehicle parts, preferentially motor vehicle doors, engine hoods, hoods and tailgates.

The folding device according to an embodiment of the invention can advantageously replace conventional pre-flanging devices in the manufacture of vehicle parts wherein an edge of the workpiece is brought into the required pre-flanging position with the help of pre-flanging jaws or pre-flanging rollers.

In summary it can be said that with the folding device according to an embodiment of the invention and with the method according to an embodiment of the invention, the folding of a workpiece can take place in a single step so that for the further assembly a workpiece is made available which following the insertion of the framework or of another part to be joined with the workpiece through flanging, can be directly finish-flanged.

BRIEF DESCRIPTION OF THE DRAWINGS

The present invention will hereinafter be described in conjunction with the following drawing figures, wherein like numerals denote like elements, and FIG. 1 schematically shows a folding device according to an exemplary embodiment of the invention;

FIG. 11 is a flow chart of a method for folding of a workpiece in accordance with an exemplary embodiment.

DETAILED DESCRIPTION

The following detailed description is merely exemplary in nature and is not intended to limit application and uses. Furthermore, there is no intention to be bound by any theory presented in the preceding background and summary or the following detailed description.

Figure 1:
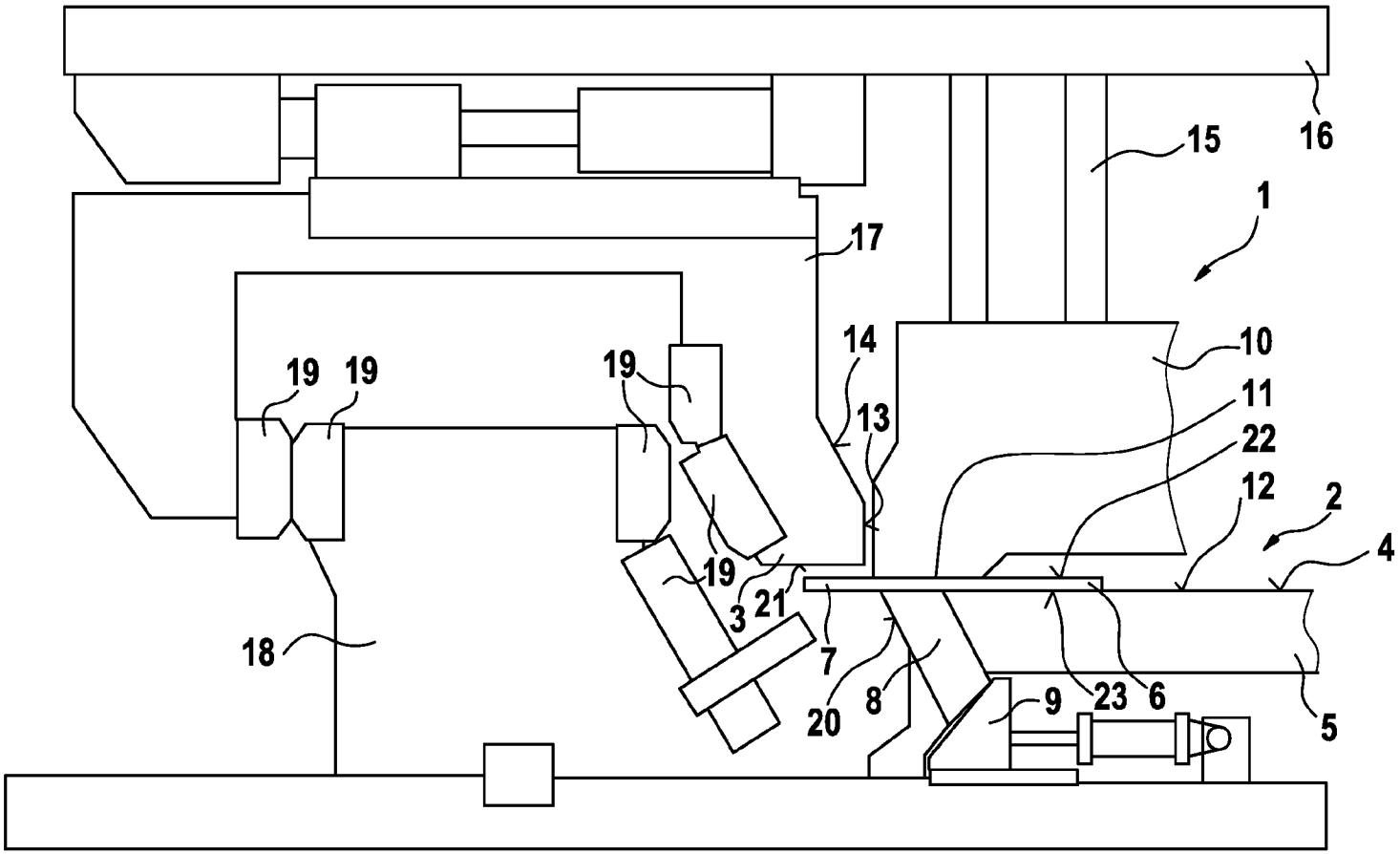

The folding device 1 according to FIG. 1 comprises a holding device 2 and a folding slide 3, wherein the holding device 2 comprises a support 5 for a workpiece 6 and a hold-down 10. The workpiece 6 in FIG. 1 rests with its lower side 23 on a support surface 4 of the support 5 and with its front region 7 protrudes over the support 5. The holding device 2 in this exemplary embodiment is designed so that the workpiece 6 in the shown processing position is orientated horizontally in the holding plane 12.

The support 5 in the front region is formed through a filling slide 8 which can be moved into the position shown through the slide 9. By moving back the slide 9 the filling slide 8 can be moved downwards from the shown position so that a finish-folded workpiece 6 can be easily removed from the folding device 1.

The hold-down 10 in a holding region 11 presses onto the top side 22 of the workpiece 6 and in this manner fixes it in the processing position. The hold-down 10 in this exemplary embodiment is held on an overhead robot 16 through a linkage 15 and can be lowered onto the workpiece 6 as far as the position shown in FIG. 1 via the linkage 15.

The folding slide 3 is part of a folding tool 17 likewise held on the overhead robot 16 and comprises a first folding surface 13 and a second folding surface 14 which are provided for pressing onto the workpiece 6. The first folding surface 13 forms an angle $\alpha$ with the second folding surface 14, wherein $\alpha$ is between more than 90 degrees and less than 180 degrees. The folding slide 3 further comprises a contact surface 21, which during the folding first comes into contact with the workpiece 6 and initiates the folding operation.

In addition, the folding tool 17 comprises guides 19 which interact with guides 19 of a guide tool 18 and guide the folding slide 3 on a predetermined path during folding.

Figure 2:
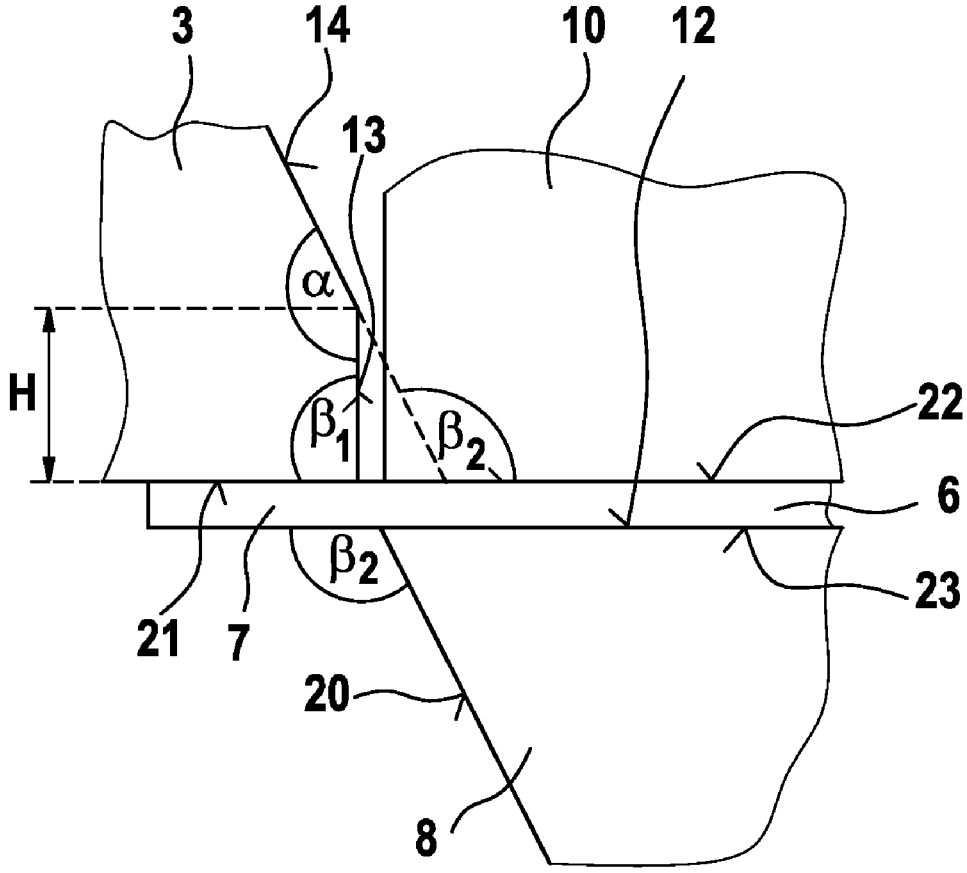
FIG. 2 shows a detail of the folding device according to FIG. 1.

FIG. 2 schematically shows a detail of the folding device according to FIG. 1. The first folding surface 13 reaches as far as to a level H of the folding slide 3 and forms an angle $\beta_1$ with the holding plane 12 which in the exemplary embodiment shown is a right angle. Above the first folding surface 13 there follows the second folding surface 14 from the height H, which forms the angle $\alpha$ with the first folding surface 13. The second folding surface 14 is inclined against the holding plane 12 by an angle $\beta_2$ which in the exemplary embodiment shown because of the right angle $\beta_1$ is equal to $\alpha$.

In order to bring the folding slide 3 from a first processing position, in which the first folding surface 13 is in contact with the workpiece, into a second processing position in which the second folding surface 14 is in contact with the workpiece and the workpiece is thus folded to a greater extent, the folding slide 3 merely has to be lowered by the height H.

The pressing-on surface 20 of the filling slide 8 is so designed that it is orientated parallel to the second folding surface 14.

FIG. 3 to FIG. 10 show steps of a method for folding a workpiece 6 according to an embodiment of the invention.

Figure 3:
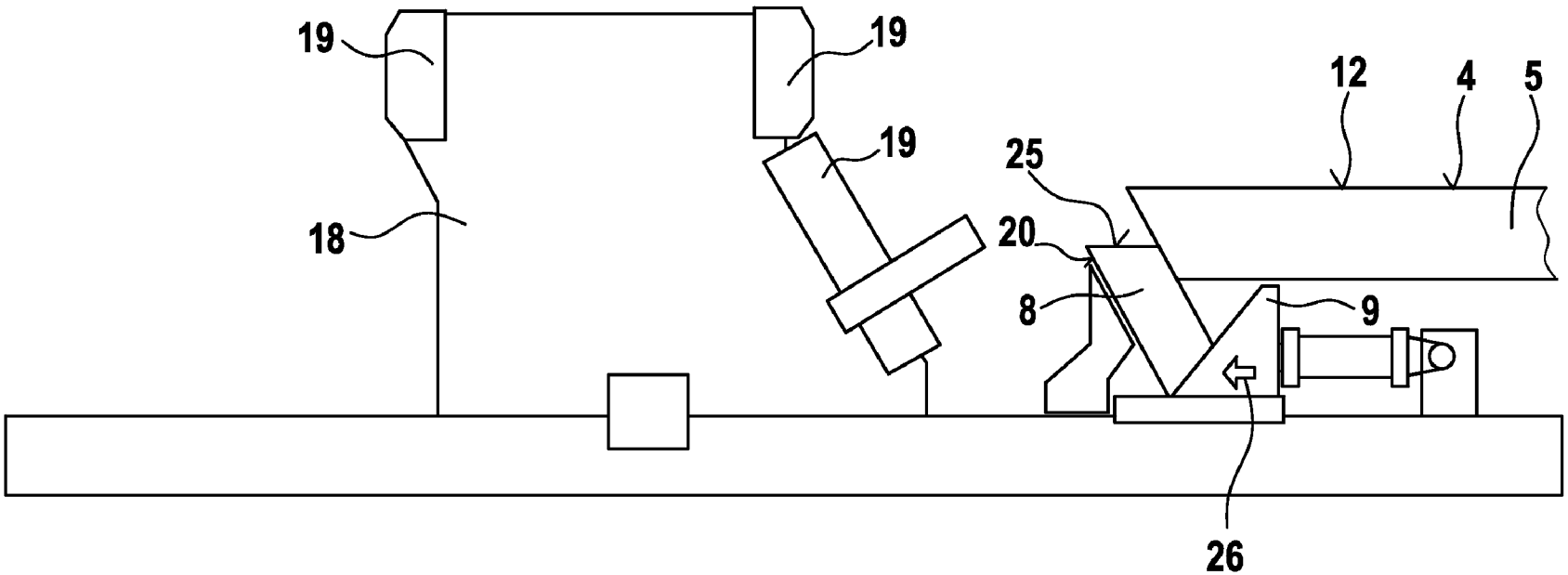
FIG. 3 to FIG. 11 show steps of a method for the folding of a workpiece according to an exemplary embodiment of the invention.

FIG. 3 shows the support 5 before the loading with a workpiece. The support 5 is partly formed by a filling slide 8 which with the help of a slide 9 moving in the arrow direction 26 can be moved into a working position, in which the filling slide surface 25 is part of the support surface 4 and lies in the holding plane 12 for a workpiece. FIG. 3 furthermore shows the guide tool 18 with guides 19.

Figure 4:
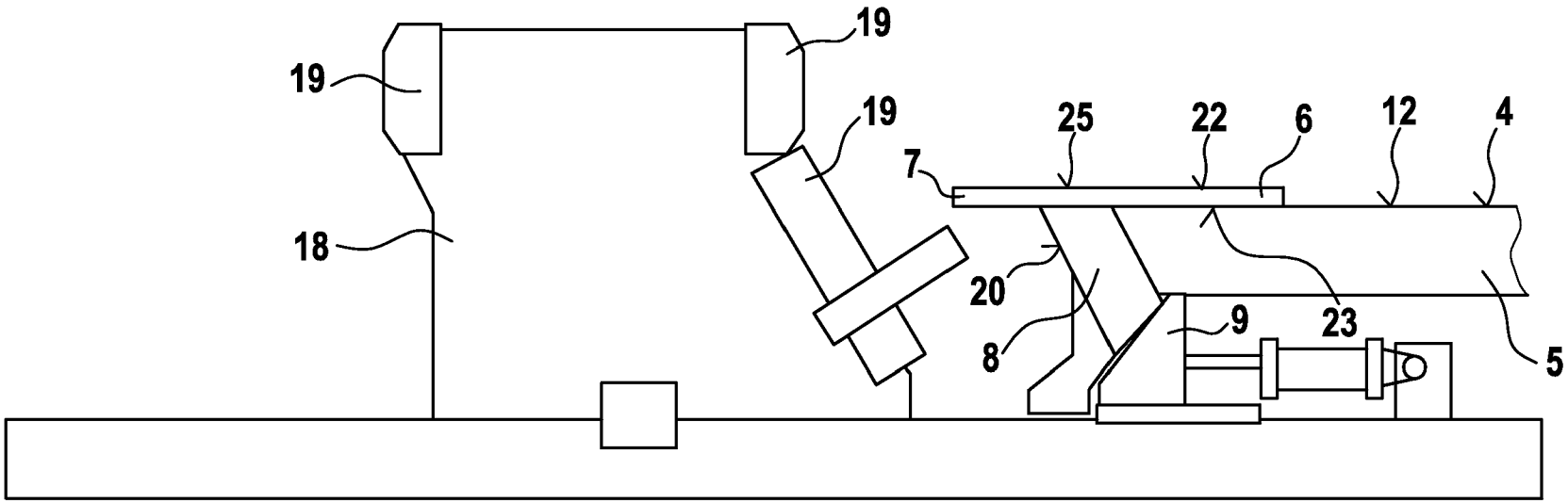

FIG. 4 shows the support 5 after the loading with a workpiece 6. Here, the slide 9 is moved into an end position and has brought the filling slide 8 into working position. The workpiece 6 typically is a sheet. It has a top side 22 and a lower side 23, wherein the lower side 23 rests on the support surface 4. With its front region 7 the workpiece 6 protrudes over the support surface 4 or the filling slide surface 15. In this representation the workpiece 6 is shown flat for simplicity. However it is also possible that it has a three-dimensional structure wherein in this case the support 5 likewise is not flat but formed as negative of the workpiece 6.

Figure 5:
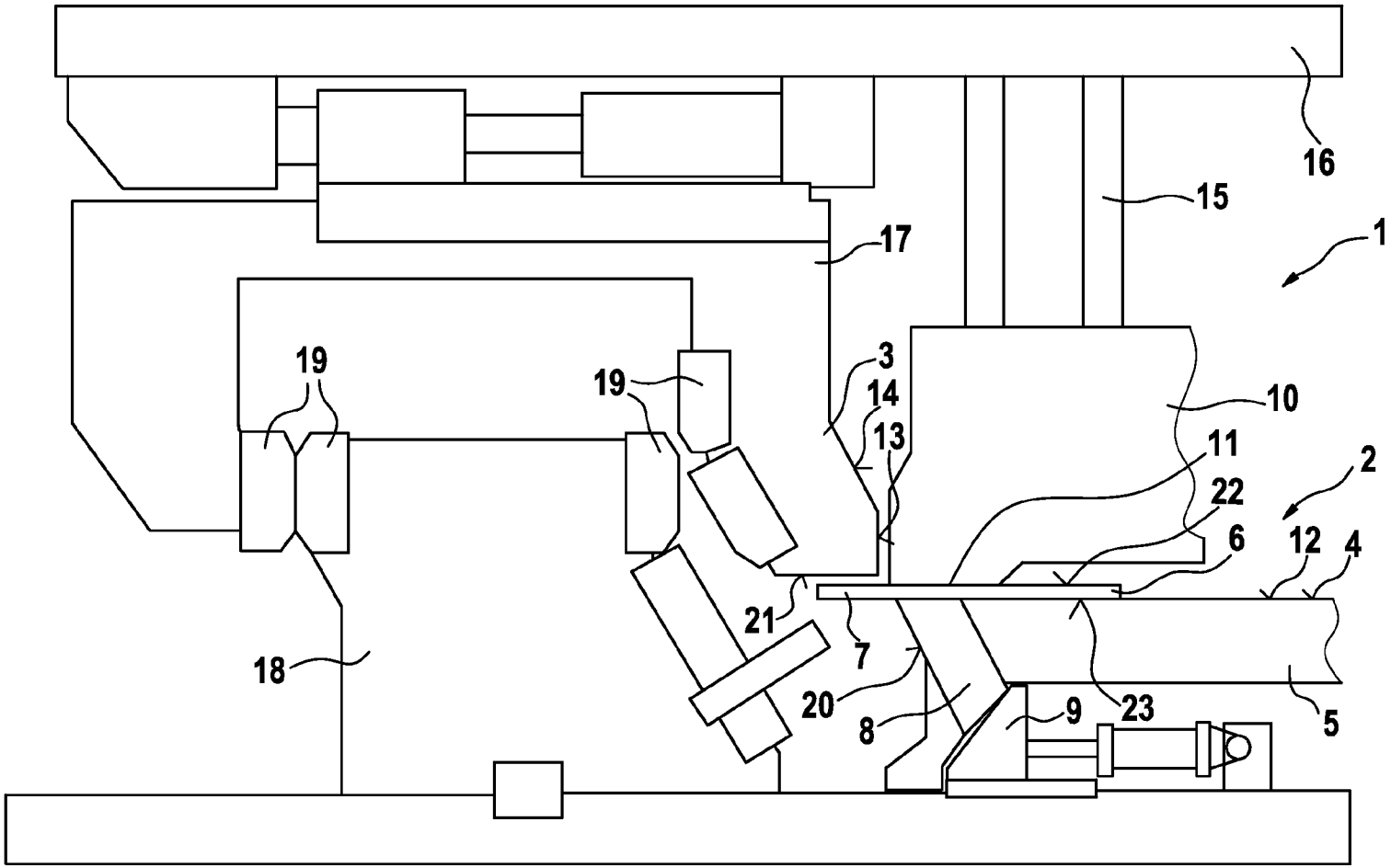

FIG. 5 shows the folding device 1 with the hold-down 10 held on an overhead robot 16 and the folding slide 3 of a folding tool 17. In the shown method step the hold-down 10 has already been moved down onto the workpiece 6 on the linkage 15 and fixes said workpiece in the holding plane 12.

The folding slide 3 likewise has lowered itself almost as far as onto the workpiece 6 and with its contact surface 21 almost touches its top side 22. In this method step, cutting of the workpiece 6 can take place simultaneously with the placing of the folding slide 3 onto the workpiece 6 if such is required.

Figure 6:
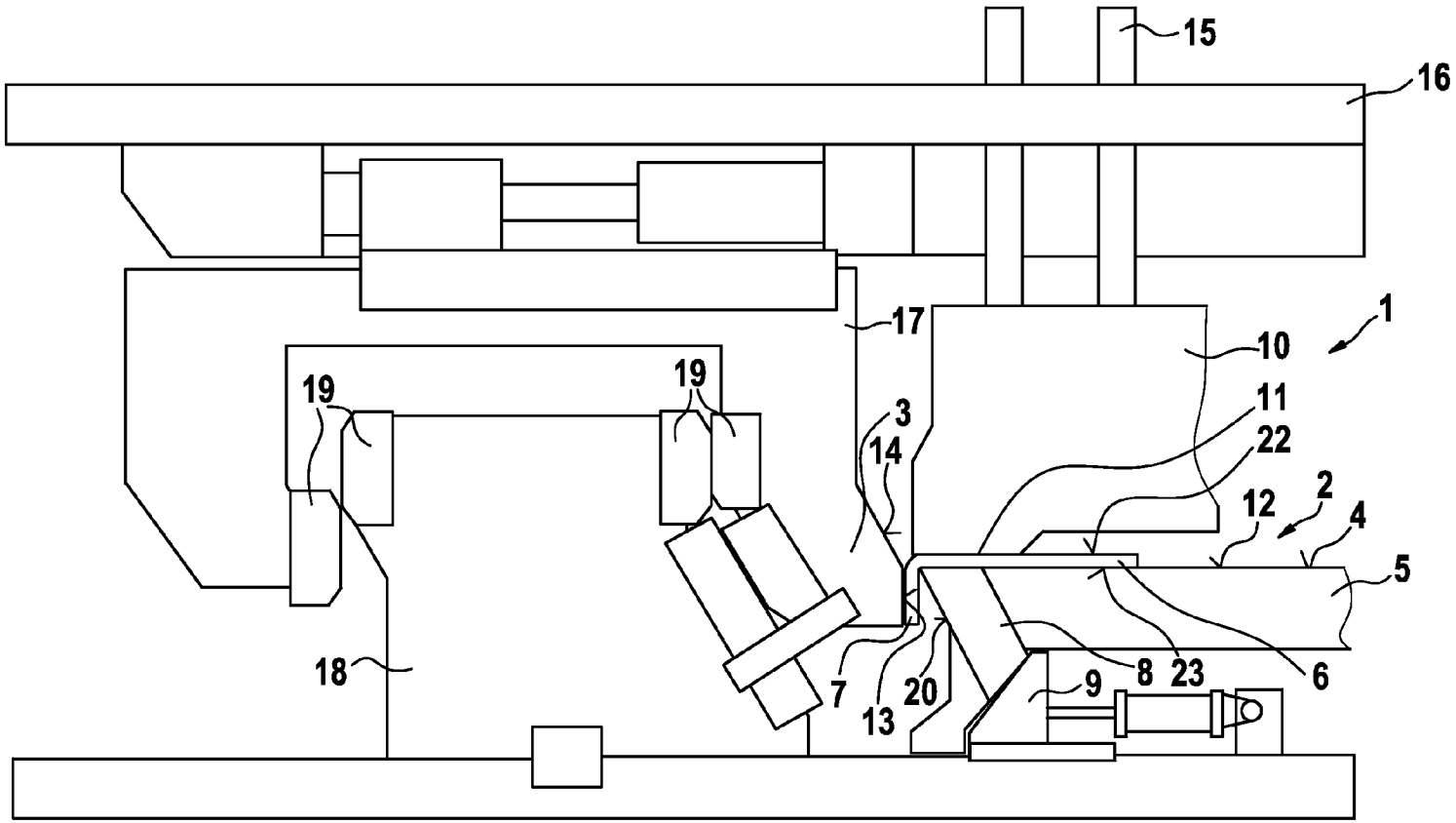

FIG. 6 shows the folding device 1 in a further step of the method. With this step the folding slide 3 has already been lowered so far that the front region 7 of the workpiece 6 has been bent vertically downwards. In this position the folding slide 3 with its first folding surface 13 presses against the top side 22 of the front region 7 of the workpiece 6.

Figure 7:
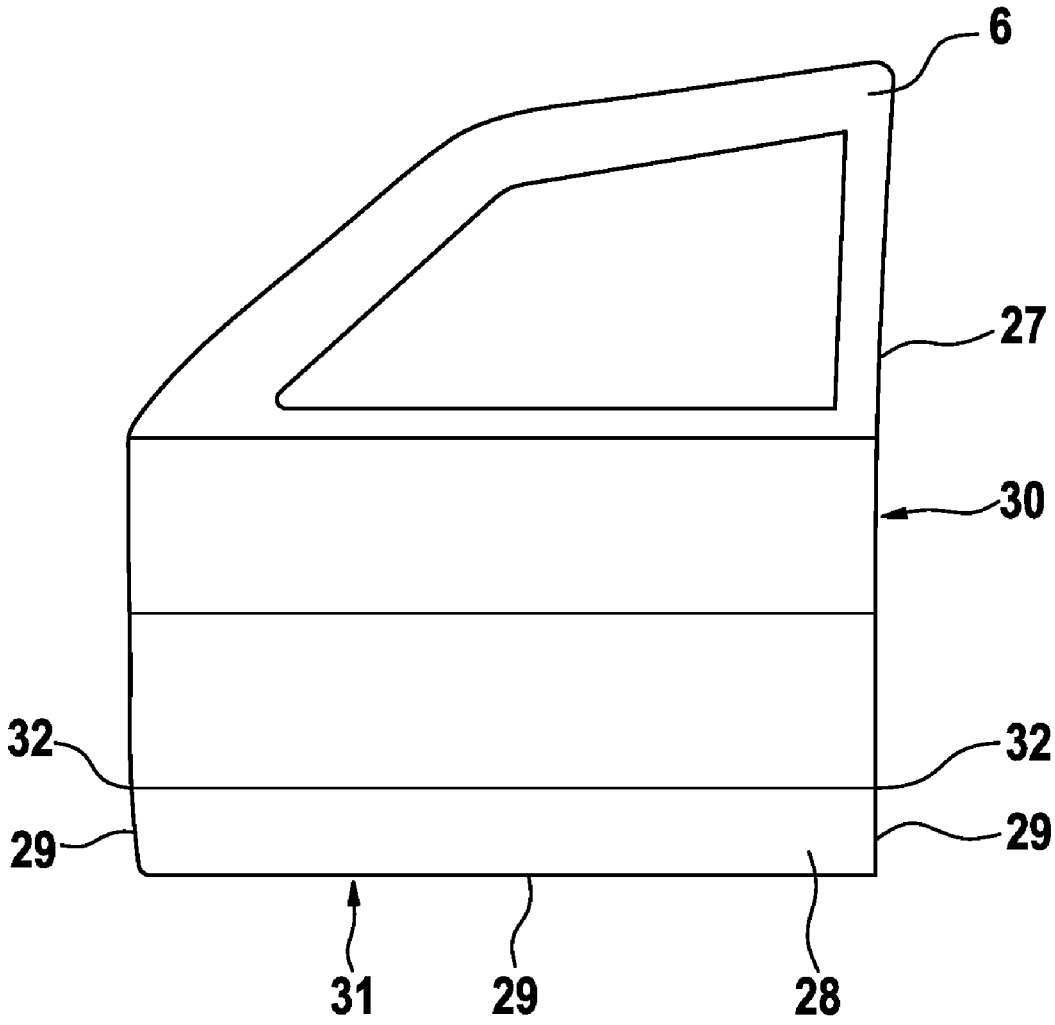

As an example for a workpiece 6, FIG. 7 shows a door for a motor vehicle or its outer skin. The door comprises edges 27 which in a process following the folding are joined with the edges of a framework through finish-flanging. For preparation of the finish-flanging the door must be folded and pre-flanged. Here reaching a folding angle of 90 degrees is however desirable with most edges 27. In the region of the sill 28 however the sill edges 29, because of the curvature of the outer skin in the region of the sill 28, ought to be folded over further, for example by approximately 105 degrees.

Accordingly, the door comprises first folding regions 30 in which the edge 27 is to be merely folded over by a first angle and second folding regions 31, in which the edge 27 is to be folded over by a second angle, wherein the second angle is greater than the first one.

With the method according to the invention all folding regions can be folded as far as the finally desired angle in a single pass, for example in a single rounding of the workpiece 6 by a robot with a folding slide. This is done as follows:

The folding of the first folding regions 30 has already been shown in FIG. 3 to FIG. 6 and described there. In these regions, the top side 22 of the front region 7 of the workpiece is brought into contact with the first folding surface 13 and the edge folded over so that after the completed folding the front region 7 of the workpiece 6 lies parallel to the first folding surface 13. Once the folding slide 3, which rounds the workpiece 6, reaches a transition 32 between a first folding region 30 and a second folding region 31, the folding slide 3 changes its height relative to the holding plane 12, lowers itself by the height H and thus brings the second folding surface 14 for the folding of the second folding regions 31 into contact with the workpiece 6.

Figure 8:
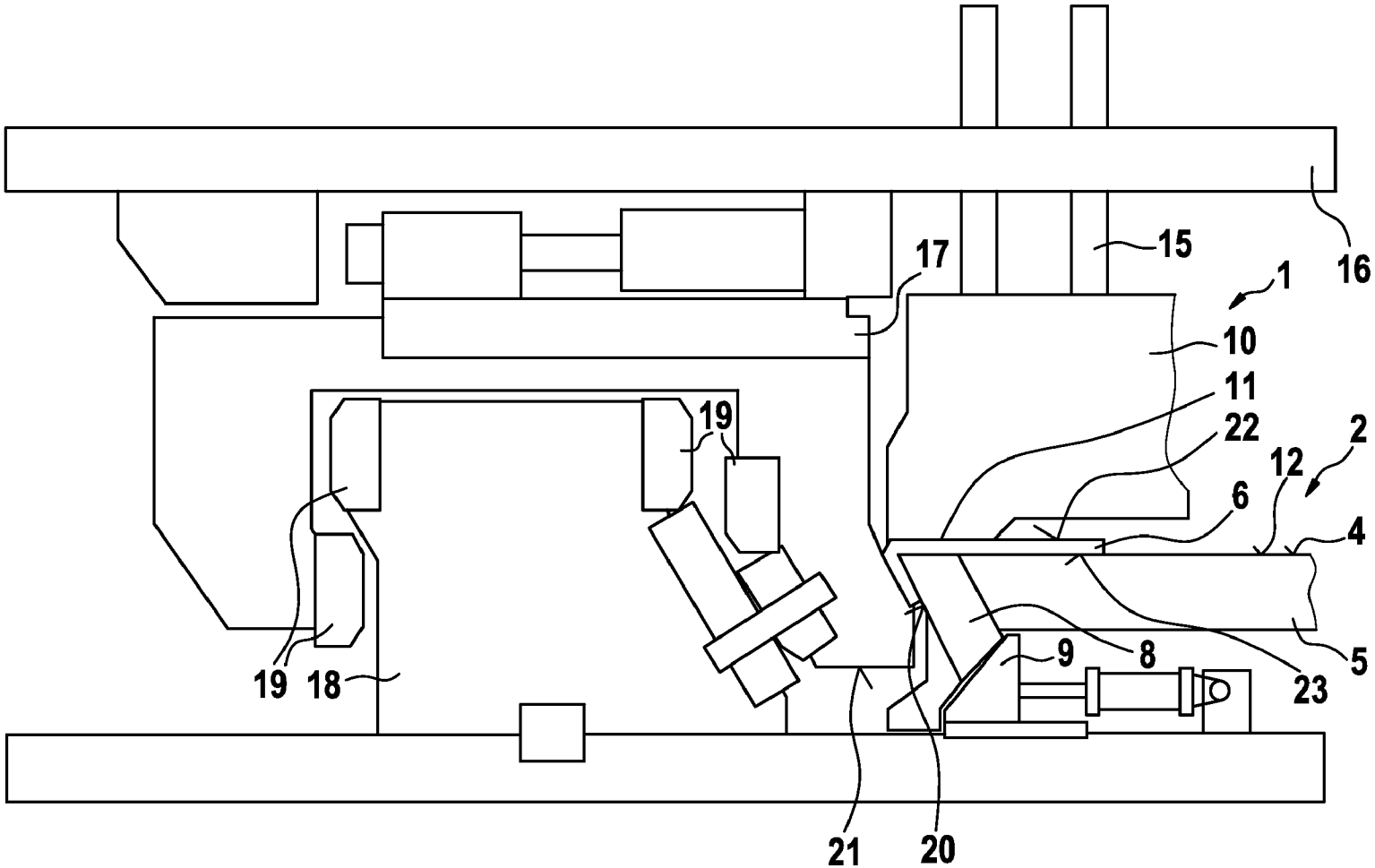

This step is shown in FIG. 8. In comparison with its position shown in FIG. 6 the folding slide 3 is moved lower into a second working position so that the second folding surface 14 now is in contact with the top side 22 of the front region 7 of the workpiece, pressing it against the pressing-on surface 20 of the filling slide 8. In this position the folding slide 3 rounds the workpiece 6 as far as to the following transition 32 which is followed by a first folding region 30.

Accordingly, with the method according to an embodiment of the invention, the folding slide 3 comprises a plurality, in this example two, working positions which are assigned to the various folding regions and in each of which other folding surfaces are in contact with the workpiece 6. Here, the folding surfaces differ from each other in their inclination towards the holding plane 12 and thus in the folding angle they produce.

Figure 9:
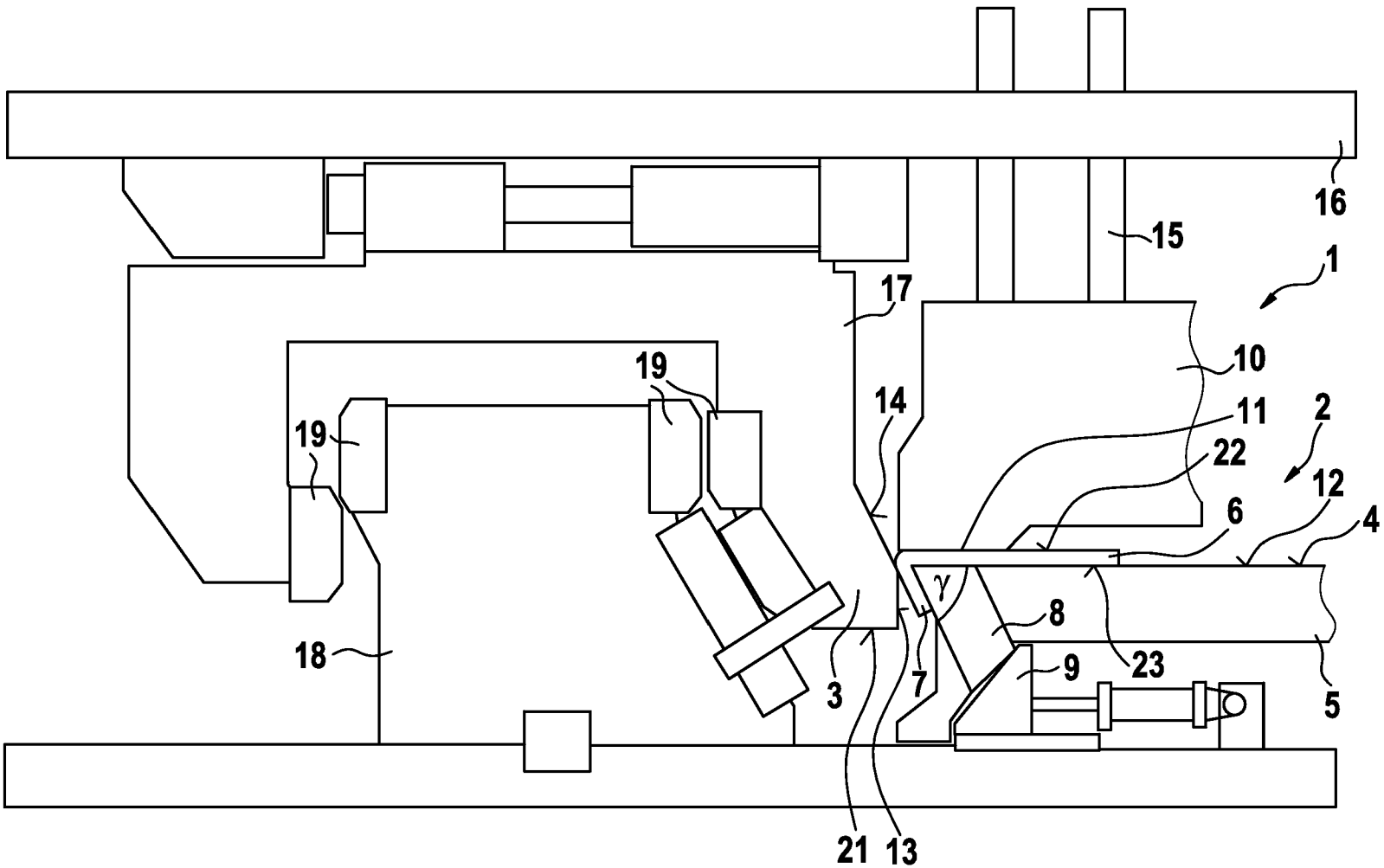

FIG. 9 shows a further step of the method. With this step, the folding of the last folding region of the workpiece 6 has taken place and the folding slide 3 again moves out of its working position to the top in order to release the workpiece 6.

The front region 7 of the workpiece 6 comprises a corresponding folding angle $\gamma$ which is subject to $\gamma=\alpha-90°$. It is complemented to approximately 180 degrees by the folding angle by which the edge was folded over.

Figure 10:
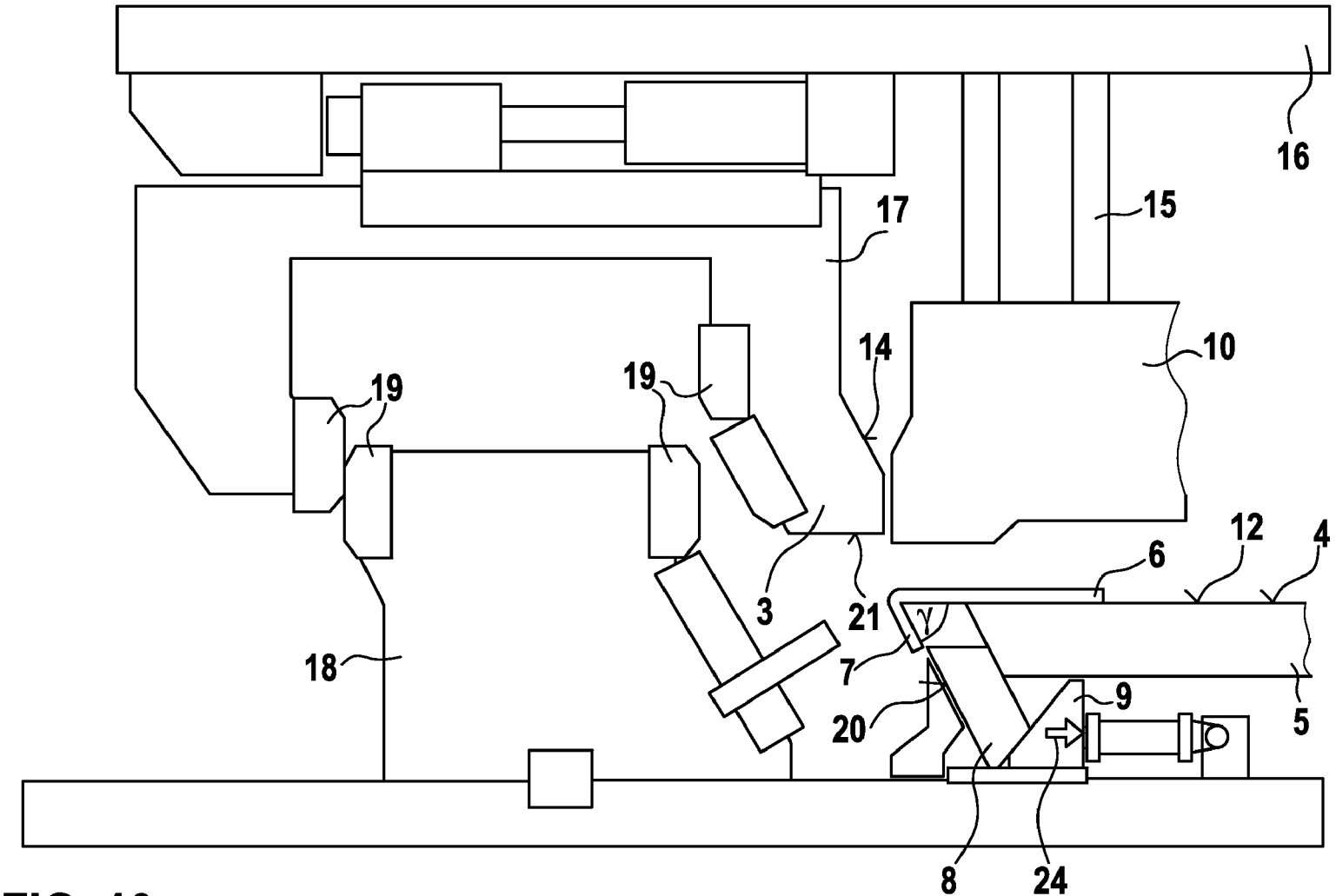
Figure 11:
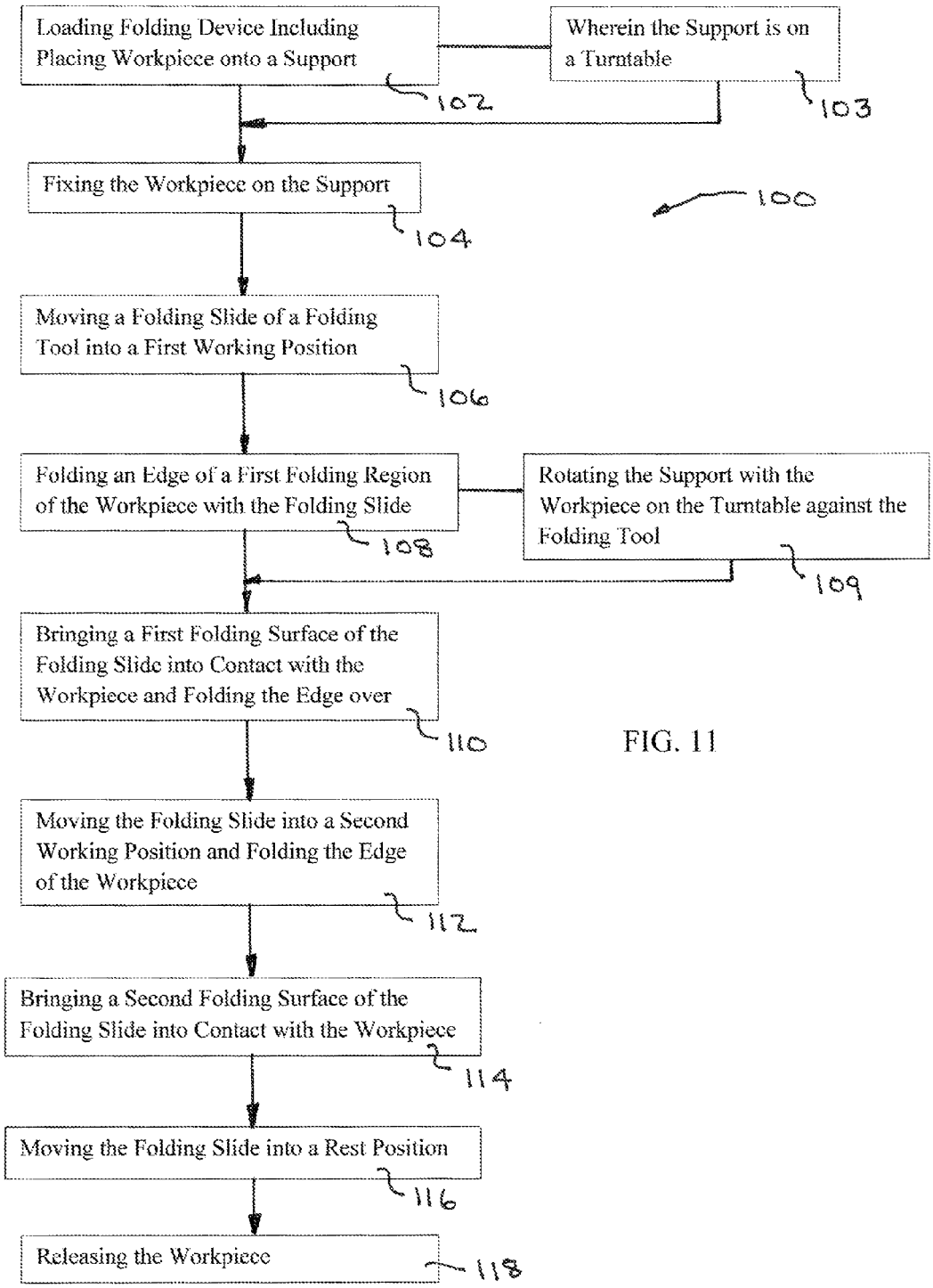

FIG. 10 shows the folding slide 3, which again has moved up almost completely from the working position. The hold-down 10 too has released the workpiece 6. The slide 9 moves back in the arrow direction 24 so that the filling slide 8 slides downwards and likewise releases the workpiece 6. The finish-folded workpiece 6 can now be removed from the folding device 1.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

The invention claimed is:

1. A folding device for processing of a workpiece, the folding device comprising:

a holding device comprising a support having a support surface that defines a holding plane, the holding device is configured for holding the workpiece in a processing position in the holding plane; and a folding slide for a folding over of an edge of the workpiece into a folding position, wherein the folding slide comprises a first folding surface and a second folding surface, wherein the first folding surface with the second folding surface forms an angle $\alpha$, the first folding surface with the holding plane forms an angle $\beta_1$ and the second folding surface with the holding plane forms an angle $\beta_2$, wherein the first folding surface and the second folding surface are intended for pressing onto the workpiece during the folding over of the edge, wherein the folding device further comprises a filling slide that comprises a first surface and a second surface and the filling slide is movable relative to the support to a working position so that the filling slide is in contact with the workpiece during the folding over of the edge, and wherein the filling slide in the working position is disposed adjacent to the support such that the first surface lies in the holding plane and the second surface is formed as a pressing-on surface inclined towards the holding plane by an angle $\gamma$.

2. The folding device according to claim 1, wherein the holding plane is substantially arranged horizontally and $\beta_1$ is substantially equal to 90° and $\beta_2>90°$.

3. The folding device according to claim 2, wherein $100° \leqq \beta_2 \leqq 110°$.

4. The folding device according to claims 1, wherein the holding device comprises a hold-down designed to substantially fix the workpiece on the support during the folding.

5. A method for folding a workpiece, comprising the steps of:

loading of a folding device with the workpiece by placing the workpiece onto a support in a holding plane, wherein a front region of the workpiece to be folded protrudes over the support and a filling slide that is in a working position disposed adjacent to the support and that has a first surface that lies in the holding plane;

fixing of the workpiece on the support through a hold-down;

moving of a folding slide of a folding tool into a first working position;

folding an edge of a first folding region of the workpiece with the folding slide;

bringing a first folding surface of the folding slide into contact with a top side of the front region of the workpiece and the edge of the workpiece is folded over as far as into a folding position;

moving of the folding slide into a second working position and folding the edge of a second folding region of the workpiece with the folding slide;

bringing a second folding surface of the folding slide into contact with a top side of the front region of the workpiece folded over as far as the folding position;

moving of the folding slide into a rest position; and releasing of the workpiece through removing the hold-down, retracting the filling slide from the working position, and removing of the folded workpiece from the folding device.

6. The method according to claim 5, wherein the folding slide from the rest position is vertically lowered into the first working position.

7. The method according to claim 5, wherein the folding slide is vertically lowered from the first working position into a second working position.

8. The method according to claim 5, wherein the support with the workpiece is arranged on a turntable and the support with the workpiece is rotated against the stationary folding tool during the folding.

9. The method according to claim 5, wherein the folding tool rounds the support with the workpiece which is stationary during the folding.

* * * * *